United States Patent [19]

Brockman

[11] Patent Number: 4,880,080

[45] Date of Patent: Nov. 14, 1989

[54] COLLAPSIBLE SAWHORSE

[76] Inventor: Lester H. Brockman, R.R. 2, Box 279, New Bloomfield, Mo. 65063

[21] Appl. No.: 261,108

[22] Filed: Oct. 24, 1988

[51] Int. Cl.[4] ..... B27B 21/00; B25H 1/06

[52] U.S. Cl. ..... 182/155; 182/225

[58] Field of Search ..... 182/155, 181–188, 182/225

[56] References Cited

U.S. PATENT DOCUMENTS

| | | | |
|---|---|---|---|
| 965,173 | 7/1910 | Fassler | 182/155 |
| 1,476,855 | 12/1923 | Topp | 182/155 |
| 2,174,952 | 10/1939 | Spikings | 182/155 |
| 2,942,854 | 6/1960 | Harding . | |
| 3,198,286 | 8/1965 | Wilson | 182/155 |
| 3,616,873 | 11/1971 | Kehrig | 182/155 |
| 3,631,941 | 1/1972 | Greenman | 182/155 |
| 4,152,834 | 5/1979 | Stansberry | 182/155 |
| 4,489,808 | 12/1984 | Voye | 182/155 |
| 4,640,386 | 2/1987 | Hall | 182/155 |
| 4,645,162 | 2/1987 | Roy | 182/155 |
| 4,711,319 | 12/1987 | Sansotta | 182/155 |

*Primary Examiner*—Reinaldo P. Machado

*Attorney, Agent, or Firm*—Gravely, Lieder & Woodruff

[57] ABSTRACT

A collapsible sawhorse includes a channel-shaped beam having a hollow interior and a pair of leg assemblies attached to the beam at opposite ends thereof. Each leg assembly includes a bracket which is attached to the beam, a block which is connected to the bracket for pivoting about an axis transverse to the beam, and a pair of legs which are attached to the block for pivoting about an offset axis which extends crosswise with respect to the transverse axis. The legs of each leg assembly move toward and away from the hollow interior of the beam when the block of that assembly pivots about the transverse axis, while the legs move toward and away from each other when pivoted about the offset axis. The legs of each leg assembly may be brought to a folded condition in which they are located side-by-side and in this condition they will fit into the interior of the beam. When the sawhorse is erected, the legs of one of the leg assemblies are fixed with respect to the block of that assembly in that they cannot pivot with respect to that block about the offset pivot axis or the beam, but the legs of the other leg assembly can pivot with respect to the block of that leg assembly, again about the offset pivot axis. This enables all four legs to come to rest on a floor so that the sawhorse assumes a stable position, even if the floor is uneven.

15 Claims, 3 Drawing Sheets

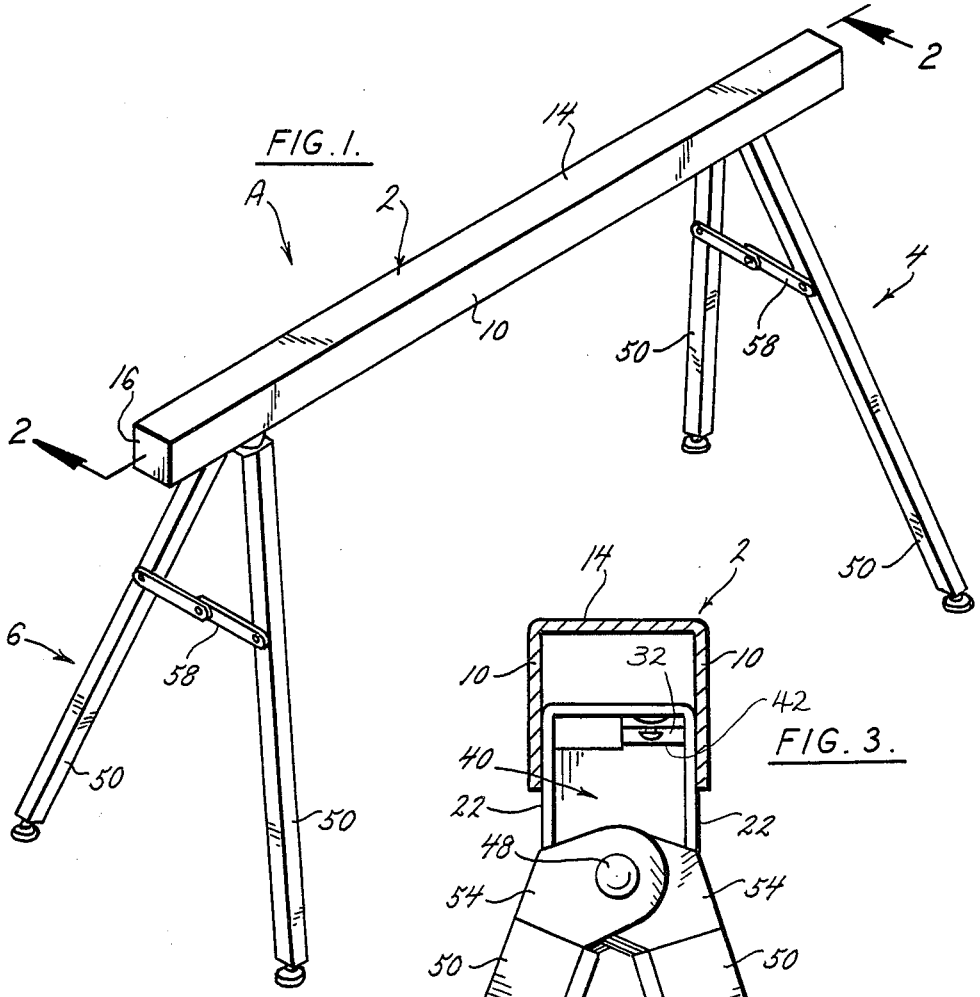
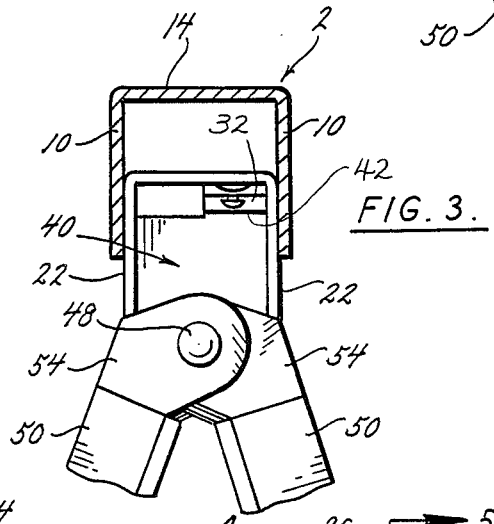
FIG. 3.
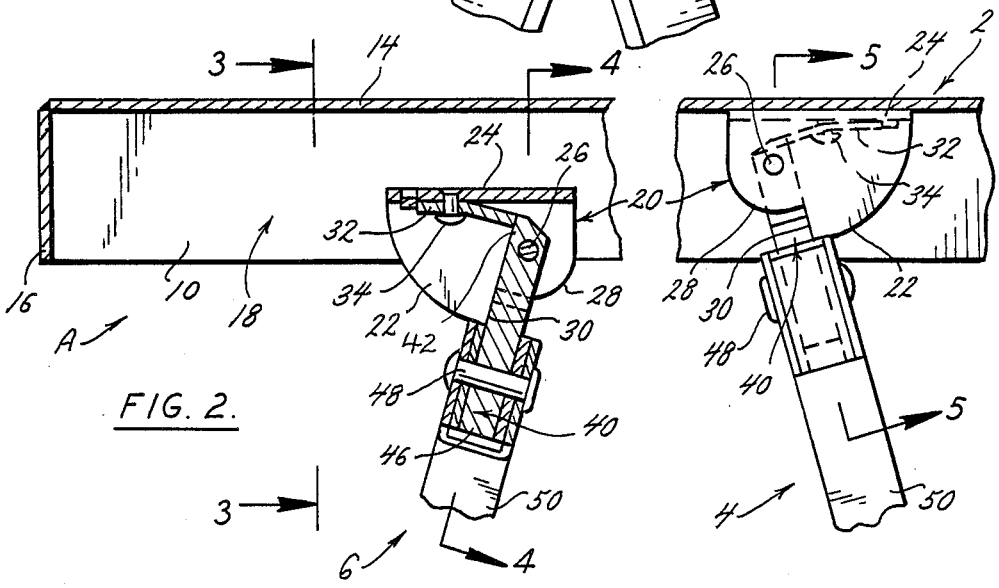
FIG. 2.

COLLAPSIBLE SAWHORSE

BACKGROUND OF THE INVENTION

This invention relates in general to sawhorses, and more particularly to a collapsible sawhorse.

Rarely does a carpenter's work proceed without a sawhorse, or usually a pair of sawhorses, and while these devices are relatively light in weight and therefore easily moved about construction sites, they are not so easily transported to and from construction sites or stored when not in use. The difficulty resides with the legs which diverge from the beam and therefore make the typical sawhorse quite cumbersome despite its relatively light weight. Indeed, only with considerable difficulty is a pair of conventional sawhorses transported in an automobile.

Moreover, the legs of conventional sawhorses attach rigidly to the beam which extends between them, and with the legs so fixed, the sawhorse will wobble if placed on an uneven floor. Some rough and much finish carpentry, however, requires a stable base for supporting lumber.

The present invention resides in a sawhorse which collapses into a highly compact configuration, yet when erected is highly stable, even on uneven floors.

DESCRIPTION OF THE DRAWINGS

In the accompanying drawings which form part of the specification and, wherein like numerals and letters refer to like parts wherever they occur.

FIG. 1 is a perspective view of a collapsible sawhorse constructed in accordance with and embodying the present invention, the sawhorse being illustrated in its erected position;

FIG. 2 is a fragmentary sectional view of the sawhorse taken along line 2—2 and showing the brackets and pivot blocks for the two leg assemblies;

FIG. 3 a sectional view taken along line 3—3 of FIG. 2;

FIG. 11 is a partial plan view taken along line 11—11 of FIG. 10; and.

DETAILED DESCRIPTION

Figure 5:
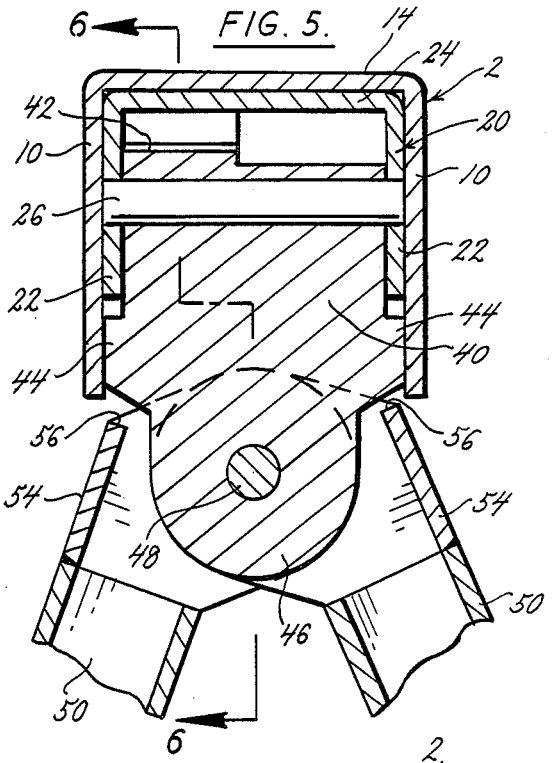
FIG. 5 is a sectional view taken along line 5—5 of FIG. 3.

Referring now to the drawings, a sawhorse A (FIG. 1), in contrast to conventional sawhorses, is capable of assuming two positions, namely a collapsed position and an erected position. In the former (FIG. 10), the sawhorse occupies little space, and is thus easily stored or transported. In the latter (FIG. 1), the sawhorse provides an elevated surface which is suitable for supporting lumber or other objects at an elevation at which work may be performed on them in a more convenient manner. Moreover, when in its erected position, the sawhorse remains stable even though the surface on which it rests may be somewhat uneven—indeed even with enough contour to cause a conventional sawhorse to wobble badly. The sawhorse includes a hollow beam 2 and a pair of leg assemblies 4 and 6 which are attached to the beam 2. When the sawhorse A is in its collapsed condition the two leg assemblies 4,6 are for all intents and purposes contained within the beam 2, but when in the erected condition, the leg assemblies 4,6 project downwardly and outwardly from the beam 2 at an oblique angle to support the beam 2 in an elevated position. All three are preferably fabricated from metal such as steel or aluminum, bot other materials are suitable as well.

The beam 2 extends the full length of the sawhorse A and possesses a channel-shaped configuration (FIGS. 1 & 9), it having spaced apart side walls 10, a top wall 14 and end walls 16. The side walls 10 lie parallel to each other, and each along one of its longitudinal margins merges into the top wall 14. The end walls 16, on the other hand, are attached to the ends of the side and top walls 10 and 14. The arrangement is such that the walls 10, 14 and 16 serve to enclose a hollow interior 18 within the beam 2, and when the sawhorse A is in its erected condition, the hollow interior 18 opens downwardly between the side walls 10,12. On the other hand, when the sawhorse A is in its collapsed condition, the legs assemblies 4,6 lie almost entirely within the hollow interior 18.

Figure 12:
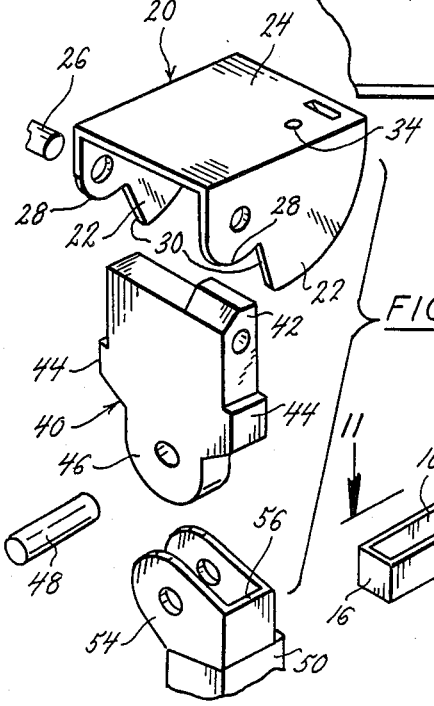
FIG. 12 is an exploded view of one of the leg assemblies.

The leg assembly 4 includes a fixed pivot bracket 20 (FIGS. 5, 6 & 12) which is attached to the beam 2 near one of its end walls 16 and within its hollow interior 18. The bracket 20 has a pair of side plates 22 which lie along the side walls 10 and a connecting segment 24 which extends between the two plates 22 and lies along the top wall 14. Indeed, the side plates 22 are attached to the side walls 10 preferably by tack welds. The two side plates 22 serve as an anchor for a pivot pin 26 which bridges the space between them, and hence extends transversely with respect to the beam 2. Below the pivot pin 26 the two side plates 22 have arcuate edges 28 which are presented generally downwardly with their centers of curvature being at the axis of the pin 26. The arcuate edges 28 lead up to stop edges 30 on the two plates 22, and the stop edges 30 project downwardly from the arcuate edges 28 somewhat oblique to the connecting segment 24.

Figure 6:
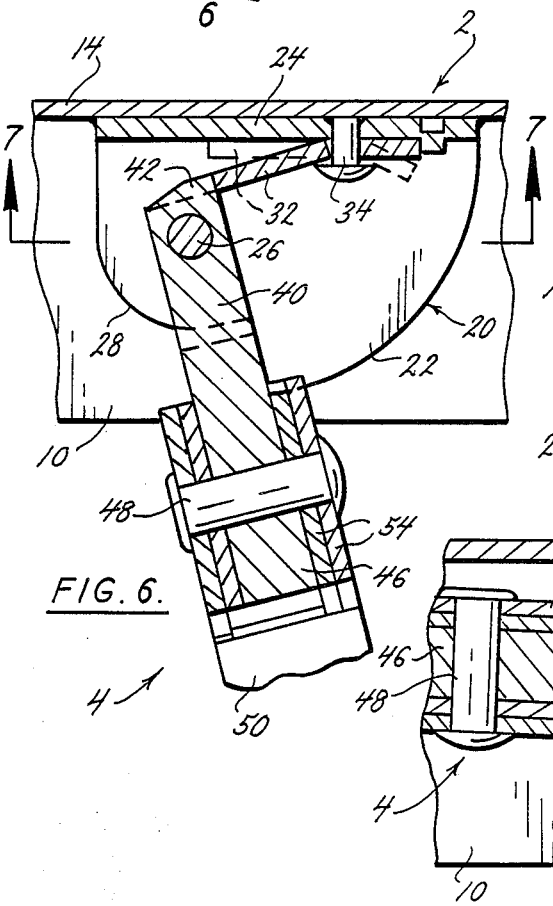
FIG. 6 is a sectional view taken along line 6—6 of FIG. 5.
Figure 7:
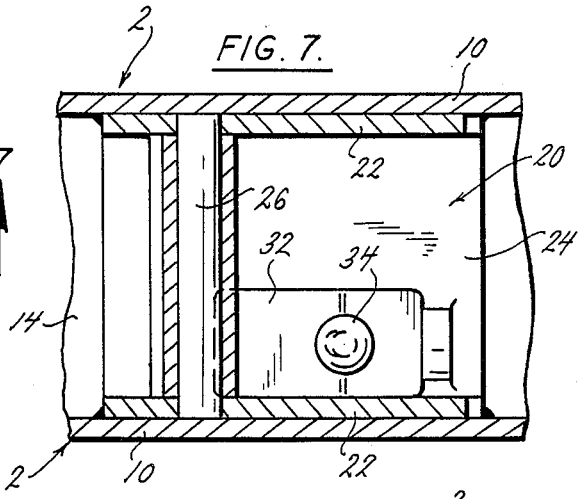
FIG. 7 is a sectional view taken along line 7—7 of FIG. 6.
Figure 8:
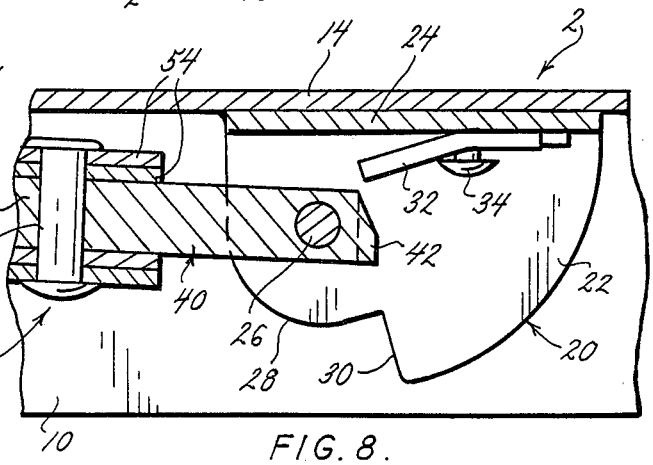
FIG. 8 is a sectional view similar to FIG. 5 in that it is taken along one of the brackets, but instead of showing the leg assembly in the erected position it is illustrated in its collapsed position.

The pivot bracket 20 carries a tang 32 (FIG. 6) which is attached to its connecting segment 24 by a rivet 34 such that the tang 32 is free to rock with respect to the connecting segment 24. Indeed, the tang 32 is slightly bent in the region of the rivet 34 so as to have a pair of arms, with one projecting generally toward the pivot pin 26 and the other away from it. The arm that projects toward the pin 26 is longer and heavier than the arm that projects away from the pin 26. As a consequence, when the beam 2 and bracket 20 are in their normal attitude, the longer arm tends to drop downwardly away from the connecting segment 24 of the bracket 20 where its end edge is presented quite close, although slightly above, the pivot pin 26, while the shorter arm bears against the connecting segment 24. Even so, with the application of a slight force, the tang 32 may be rocked upwardly so that its longer arm is against the connecting segment 24.

on to the fixed pivot bracket 20, the leg assembly 4 includes a movable pivot block 40 (FIGS. 5, 6 & 12) which rotates on the pivot pin 26 that is anchored in the bracket 20. The movable block 40, which is of constant thickness, lies partially within the space between the two side plates 22, where it fits somewhat snugly, so that it will not move axially along the pin 26, yet the fit is not so snug as to Prevent the block 40 from rotating. Immediately above the pin 26, the block 40 has a raised stop 42 which aligns with the tang 32 and indeed bears against the tang 32. One of the ends of the stop 42 is beveled with respect to the upper end of the block 40, while the other end is squared off. When the block 40 projects away from the connecting portion 24 of the fixed bracket 20 at the proper angle, the squared off end of the stop 42 will lie directly opposite the end of the longer arm of the tang 32, assuming that arm has dropped downwardly, and thus the tang 32 restricts rotation of the block 40 (FIG. 6). However, the tang 32 may be rocked upwardly so that its longer arm is against the connecting segment 24 of the bracket 20, and when this occurs, the tang 32 clears the stop 42 and allows the block 40 to be rotated (FIG. 8).

Below the pivot pin 26, the block 40 has two more stops 44 (FIGS. 5 & 12) which project laterally beyond the arcuate edges 28 and the stop edges 30 of the side plates 22 for the fixed pivot bracket 20. The arcuate edges 28, being offset slightly from the laterally directed stops 44, permit the block 40 to rotate on the pivot pin 26, but the stop edges 30 lie in the path of the stops 44 and, like the tang 32, restrict rotation (FIG. 6). Indeed, the tang 32 restricts rotation in one direction, whereas the stop edges 30 restrict rotation in the opposite direction. The arrangement is such that when the stops 44 of the block 40 are against the stop edges 30 of the bracket 20, the squared off end of the other stop 42 lies slightly beyond the end edge of the tang 32, so the tang 32 can rock downwardly into the position in which the end of its long arm blocks the stop 42 (FIG. 6). In this condition little free motion is accorded the block 40, so that the block 40 is for all intents and purposes locked in position. However, when the tang 32 is rocked upwardly, the upper stop 42 is free to pass under it, and indeed, the longer am of that tang 32 will ride on the beveled end of the stop 42 (FIG. 8).

The pivot block 40 projects below the two laterally directed stops 44 where it is provided with a knuckle 46 (Figs. 5, 6 & 12) through which another pivot pin 48 passes. Whereas the transverse pivot pin 26 lies parallel to the major surface areas of the pivot block 40, the pin 48 lies perpendicular to those surface areas. Thus, the pivot pin 48 is both offset and extended crosswise with respect to the transverse pin 26. The knuckle 46 is somewhat narrower than the remainder of the block 40 so the laterally directed stops 44 project beyond it as well.

Figure 9:
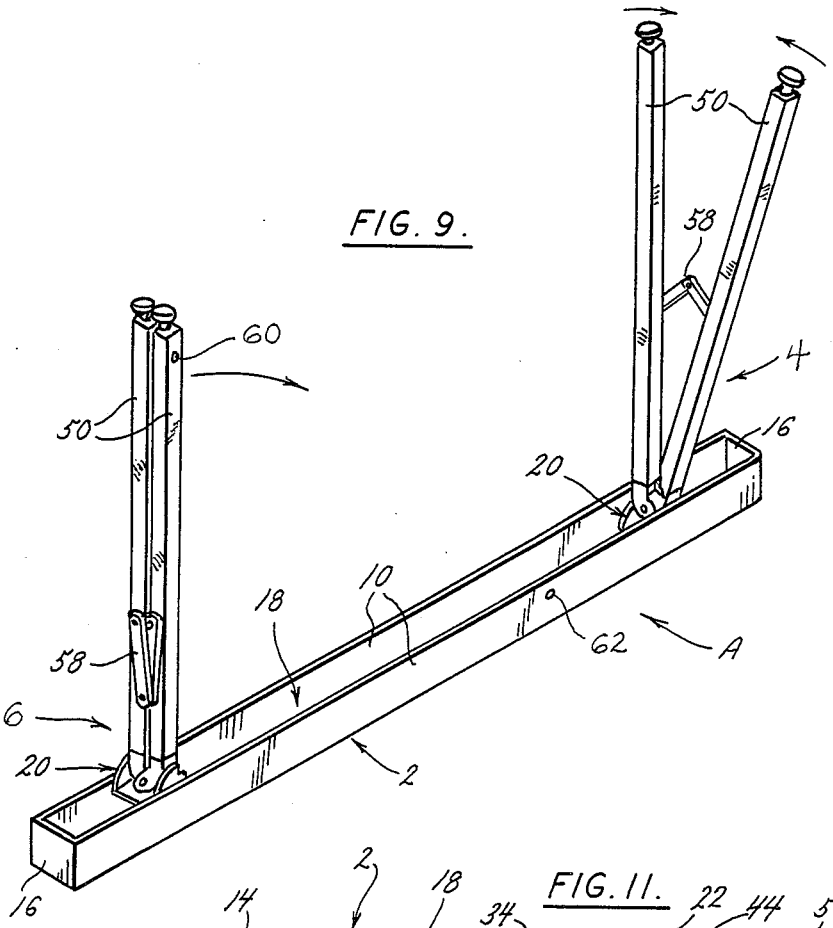
FIG. 9 is a perspective view of the sawhorse inverted with the legs of one of its leg assemblies completely folded and the legs of its other leg assembly partially folded.
Figure 11:
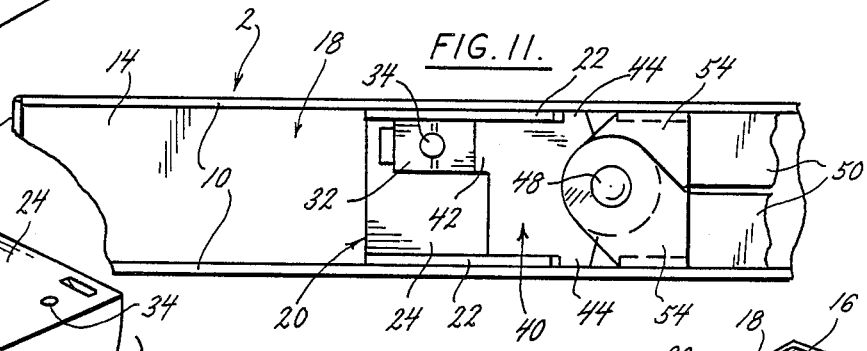

Finally, the leg assembly 4 includes two legs 50 which extend from the pivot block 40. Each leg 50 is tubular and the two when located side-by-side (FIG. 9) occupy a space no wider than the width of the hollow interior 18 for the beam 2. Moreover, the length of each leg 50 is somewhat less than the distance between the two leg assemblies 4,6 that is the distance between the locations at which they extend from beam 2. Each leg 50 at its upper end is fitted with a clevis 54 (FIGS. 5, 6 & 12) which forms an integral and rigid part of that leg, and the two clevises 54 fit over the knuckle 46 of the movable pivot block 40 where they are connected to the block 40 by the pivot pin 48. This enables the legs 50 to pivot about the axis of the pivot pin 48 and in so doing fold toward and away from each other (FIG. 9). Each clevis 54 has an upwardly presented stop edge 56 which extends between its two legs 50 and the stop edges 56 of the two clevises 54 are normally spaced from the stops 44 for the pivot block 40 when the legs 50 are spread to their fully open positions—a Position in which the angle between the two legs is about 40°(FIG. 5). The clevises 54 are configured such that the pivot axis for the pin 48 lies along the inside face of each leg 50,52, and this allows the legs 50 to fold inwardly toward each other until they reach a folded condition in which the inside faces of the legs 50 are face-to-face.

The two legs 50 intermediate their ends are connected by a folding or scissors-type link 58 which is fully extended, that is straight, when the legs 50 are in their fully open or spread position. Indeed, the link 58 is configured to lock in the straight position and thus hold the legs 50 apart in their fully open position. However, by applying a small force at the center of the link 58, it will break, so to speak, to allow the legs 50 to move together to their collapsed position, in which event the link 58 will also fold. Since the stop edges 56 for the clevises are spaced slightly from the stops 44 when the legs 50 are spread to the fully open position, the two legs 50 can pivot about the pin 48, within a limited angle, even though they are fully open.

Figure 10:
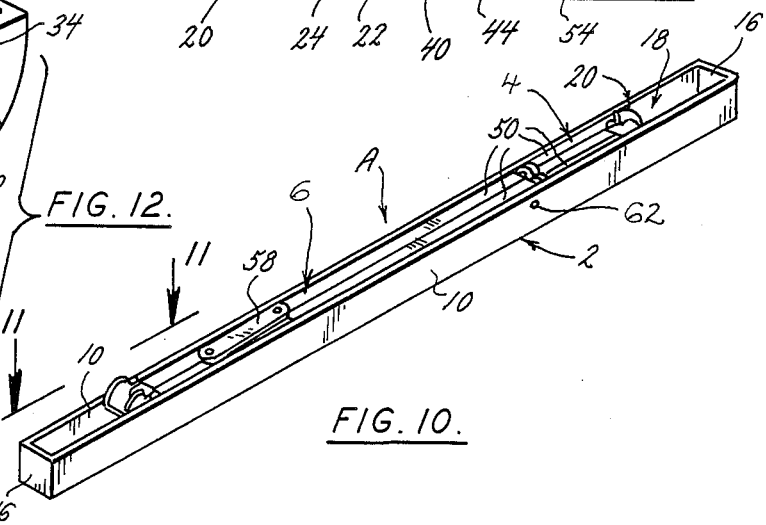
FIG. 10 is a perspective view of the sawhorse in its collapsed position.

Thus, by reason of the pivot bracket 20 and the pivot block 40, the legs 50 can move between an erected position (FIG. 1) and a collapsed position (FIG. 10). In the former the legs 50 project obliquely from the beam 2 and are spread apart so as to support the beam 2 in an elevated position above a floor. The tang 32 prevents the block 40 from rotating in the bracket 20, while the scissors link 58 prevents the two legs 50 from moving together toward their folded position. In the collapsed position, the legs 50 are contained wholly within the hollow interior 18 of the beam 2.

To move the legs 50 from their fully erected position to their collapsed position, the scissors link 58 is broken, that is a fold is initiated in it, and the two legs 50 are moved together until they lie parallel to each other with their inside faces generally in contact (FIG. 9). The tang 32 is depressed to shift its end edge away from the stop 42 on the upper end of the block 40, and this of course frees the block 40 so that it can pivot relative to the pivot bracket 20 (FIGS. 6 & 8). Indeed, at this time the collapsed legs 50 are swung inwardly toward the beam 2, this pivotal movement being accommodated by rotation of the pivot block 40 in the bracket 20 about the axis of the pivot pin 26. As the pivot block 40 rotates, its stops 44 move away from the stop edges 30 on the bracket 20, whereas the tang 32 rides over the beveled end on the stop 42 at the other end of the bracket 20. The two legs 50 pivot toward and fit into the hollow interior of the beam 2 where they rest against the top wall 14.

To move the legs 50 from their collapsed to their erected position, the free ends of the collapsed legs 50 are grasped within the hollow interior 18 of the beam 2 and pulled outwardly to withdraw the legs 50 from the hollow interior 18. The block 40 pivots in the bracket 20, and as it does, the stops 44 on the block 40 move along the arcuate edges 28 on the bracket 20, while the beveled end on the stop 42 moves past the tang 32 and cams it away from the block 40 if it is in the way. The legs 50 move over center, that is beyond the position in which they are perpendicular to the beam 2, and come to rest in a slightly oblique position when the stops 44 on the block 40 come against the stop edges 30 on the bracket 20. If the legs 50 are presented downwardly at this time, the tang 32, under its own weight, will drop down behind the stop 42 on the block 40 and thus the tang 32 and stop edges 30 lock the block 40 against rotation in either direction (FIG. 6). At this time the legs 50 are spread apart to their fully open position, and in this position the stop edges 56 on the two clevises 54 may bear against one stop 44 or the other on the block 40, while the scissors link 58 becomes straight, but most likely the stop edges 56 will be spaced from both stops (FIG. 5), thus allowing the two legs 50 a limited amount of pivotal movement as a unit, they being held in a fixed angular position with respect to each other by the scissors link 58. Thus, when the legs 50 are fully erected, they can pivot about the pin 48, but the block 40 cannot pivot about its pin 26. In effect, the legs 50 of the leg assembly 4 will rotate relative to the beam 2 about an axis that generally follows the beam 2.

Figure 4:
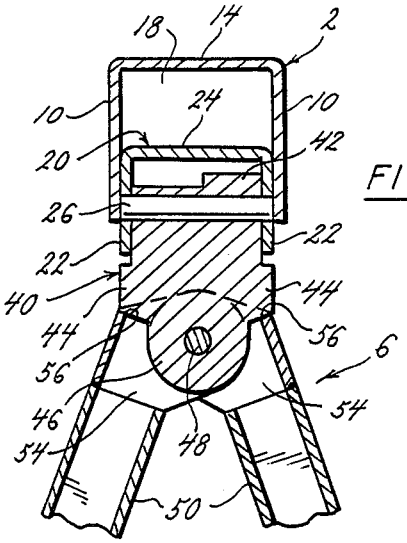
FIG. 4 is a sectional view taken along line 4—4 of FIG. 3.

The leg assembly 6 (FIGS. 2 & 4) is essentially the same as the leg assembly 4, but its fixed pivot bracket 20 is set somewhat lower in the beam 2 at the opposite end of the beam 2, of course. Indeed, the connecting segment 24 of the bracket 20 for the leg assembly 6 is spaced from the top wall 14 of the beam 2 a distance which is equal to or slightly greater than the greatest thickness of the legs 50 for the leg assembly 4. This enables the legs 50 of the assembly 6, when folded and collapsed, to lie along the legs 50 of the assembly 4 (FIG. 10). In other words, the arrangement is such that the legs 50 of the assembly 4 lie along the top wall 14 of the beam 2, whereas the legs 50 of the assembly 6 lie along the lower margins of the side walls 10,12 of the beam 2 when the sawhorse A is in its collapsed position. Of course, when the sawhorse A is erected the legs 50 of the assembly 6 project obliquely in the opposite direction from the legs 50 of the assembly 4. Finally, when the legs 50 of the leg assembly 6 are spread to their fully open position, the position in which their scissors link 58 is straight, the stop edges 56 for its two clevises 54 lie against the stops 44 on the pivot block 40, so the legs 50 will not pivot relative to the block 40 or beam 2. Thus, when the sawhorse A is in its fully erected position the legs 50 of the leg assembly 6 are fixed in position with respect to the beam 2, whereas the legs 50 of the leg assembly 4 will move as a unit about the pivot pin 48 of the block 40 from which those legs extend. This enables the legs 50 of the two leg assemblies 4,6 to adjust to variances in a floor, so that all four legs 50 will rest solidly on the floor even if the floor is uneven, and yet will hold the beam 2 in a fixed position above the floor.

Also, one of the legs 50 of the leg assembly 6 has a detent 60 (FIG. 9) which snaps into a hole 62 in one of the side walls 10 of the beam 2 when the leg assembly 6 is folded into the hollow interior 18 of the beam 2. This retains both leg assemblies 4 and 6 in their retracted positions.

The legs 50 of the leg assembly 6 are moved between their collapsed and erected positions in the same manner as the legs 50 of the assembly 4, but since the legs 50 of the assembly 4, when the sawhorse A is totally collapsed, lie along the top wall 14 of the beam 2, they must be folded into the interior of the beam 2 first and withdrawn last.

This invention is intended to cover all changes and modifications of the example of the invention herein chosen for purposes of the disclosure which do not constitute departures from the spirit and scope of the invention.

What is claimed is:

1. A collapsible sawhorse comprising: a channel-shaped beam having parallel side walls which lie along a hollow interior; first and second leg assemblies attached to the beam at opposite ends thereof, each leg assembly including a pivot block which pivots relative to the beam about a first axis that is transverse to the beam and a pair of legs which pivot about a second axis relative to the block between a folded position, wherein they are side-by-side and against each other, and an open position, wherein they are spread apart, the second axis being fixed in position with respect to the first axis and oriented crosswise with respect to the first axis, the legs when in their folded position being capable of fitting into the hollow interior of the beam between the parallel side walls, with the folded legs of the first leg assembly overlying the folded legs of the seconded leg assembly; whereby the sawhorse collapses into a highly compact configuration; and means carried by a leg of the first leg assembly for engaging in a side-wall of the beam and thereby preventing the legs assemblies from pivoting about the first axes and swinging out of the hollow interior of the beam.

2. A sawhorse according to claim 1 wherein each leg assembly includes a pivot bracket and a first pivot pin which is connected to the bracket and extends through the pivot block to establish the first axis.

3. A sawhorse according to claim 1 wherein the legs are provide at their ends with clevises; wherein the pivot block of each leg assembly has a knuckle along which the clevices for the two legs of that leg assembly lie; and wherein each leg assembly includes a second hinge pin which extends through the block and through the clevices for the leg to establish the second pivot axis.

4. A sawhorse according to claim 1 wherein the leg assemblies include positioning means for securing the legs of the two leg assemblies in an erected position in which the legs of each leg assembly project at a substantial angle from the beam and are spread apart with respect to each other.

5. A collapsible sawhorse comprising: a beam having a hollow interior; and first and second leg assemblies attached to the beam at opposite ends thereof; each leg assembly including a pivot block which pivots relative to the beam about a first axis that is transverse to the beam and a pair of legs which pivot about a second axis relative to the block between a folded position, wherein they are side-by-side, and an open position, wherein they are spread apart, the legs when in their folded position being capable of fitting into the hollow interior of the beam, with the folded legs of the first leg assembly; whereby the sawhorse collapses into a highly compact configuration, the leg assemblies including positioning means for securing the legs of the two leg assemblies in an erected position in which the legs of each leg assembly project at a substantial angle from the beam and are spread apart with respect to each other, the positioning means for each leg assembly including a first stop means at the pivot block for preventing the legs from pivoting beyond a predetermined angle with respect to the beam.

6. A sawhorse according to claim 5 wherein the positioning means for each leg assembly includes a second stop means for preventing the legs from moving away from the predetermined angle toward the interior of the beam.

7. A sawhorse according to claim 6 wherein the second stop means is releaseable to permit the legs to fold back toward the interior of the beam.

8. A sawhorse according to claim, 7 wherein the positioning means also includes third stop means extended between the legs of each pair for holding those legs at a predetermined angle with respect to each other.

9. A sawhorse according to claim 8 wherein the positioning means includes fourth stop means for restricting the angle the legs can pivot relative to the beams about the second pivot axis.

10. A sawhorse according to claim 9 wherein the fourth stop means of the leg assemblies prevents all pivotal movement between the legs and the block for that leg assembly about the second pivot axis; and the fourth stop means of the other leg assembly permits limited pivotal movement between the legs and the block of that leg assembly about the second pivot axis thereof, whereby the sawhorse will assume a stable position on an uneven floor.

11. A collapsible sawhorse comprising: a beam having hollow interior; and first and second leg assemblies attached to the beam at opposite ends thereof; each leg assembly including a pivot block which pivots relative to the beam about a first axis that is transverse to the beam and a pair of legs which pivot about a second axis relative to the block between a folded position, wherein they are side-by-side, and an open position, wherein they are spread apart, the legs when in their folded position being capable of fitting into the hollow interior of the beam, with the folded legs of the first leg assembly overlying the folded legs of the second leg assembly, whereby the sawhorse collapses into a highly compact configuration, the leg assemblies including positioning means for securing the legs of the two leg assemblies in an erected position in which the legs of each leg assembly project at a substantial angle from the beam and are spread apart with respect to each other, the legs of one of the leg assembly being incapable of pivoting relative to the beam at the second pivot axis when in its erected condition, and the legs of the other leg assembly being capable of pivoting relative to the beam at the second pivot axis when in its erected condition, whereby the sawhorse will assume a stable condition on an uneven floor.

12. A sawhorse according to claim 11 wherein the beam is channel-shaped.

13. A collapsible sawhorse comprising: a beam having a hollow interior, a first pivot block connected to the beam for pivoting about a first transverse axis that extends transversely with respect to the beam; a first pair of legs connected to the first block for pivoting about a first offset axis that is oriented crosswise with respect to the transverse axis, the first block when pivoted about the transverse axis causing the legs to move toward and away from the beam, the legs when pivoted about the first offset axes being capable of moving between a closed position wherein they are together and an open position wherein they are spread apart at a predetermined angle and are fixed in position with respect to the first block; a second pivot block connected to the beam remote from the first pivot block for pivoting about a second transverse axis that extends transversely with respect to the beam, a second pair of legs connected to the second block for pivoting about a second offset axis that is oriented crosswise with respect to the second transverse axis, the second block when pivoted about the second transverse axes causing the legs to move toward and away from the beam, the legs when pivoted about the second offset axis being capable of moving between a closed position wherein they are together and an open position wherein they are spread apart at a predetermined angle and are further capable of still pivoting with respect to the block about the second offset axis.

14. The sawhorse according to claim 13 wherein the legs of each pair when in their folded condition will fit into the hollow interior of the beam, whereby the sawhorse assumes a high compact configuration.

15. The sawhorse according to claim 14 wherein the legs of the first pair fit over the legs of the pair within the interior of the beam when the sawhorse is in its collapsed condition.

* * * * *

UNITED STATES PATENT AND TRADEMARK OFFICE

CERTIFICATE OF CORRECTION

PATENT NO. : 4,880,080

DATED : November 14, 1989

INVENTOR(S) : Lester H. Brockman

It is certified that error appears in the above-identified patent and that said Letters Patent is hereby corrected as shown below:

Column 1, line 30, cancel "and," and substitute therefor "and".

Column 3, line 5, cancel "on" and substitute therefor "In addition".

Column 4, line 11, cancel "Position" and substitute therefor "position".

Column 6, line 28, cancel "legs" and substitute therefor "leg".

Signed and Sealed this

Thirtieth Day of October, 1990

*Attest:*

HARRY F. MANBECK, JR.

*Attesting Officer*

*Commissioner of Patents and Trademarks*